US005267580A

United States Patent [19]

Payzant

[11] Patent Number: 5,267,580

[45] Date of Patent: Dec. 7, 1993

[54] DISHWASHING MACHINE AND METHOD

[75] Inventor: Russell L. Payzant, Olathe, Kans.

[73] Assignee: TCA, Inc., Kansas City, Kans.

[21] Appl. No.: 970,159

[22] Filed: Nov. 2, 1992

Related U.S. Application Data

[62] Division of Ser. No. 815,500, Dec. 30, 1991.

[51] Int. Cl.[5] ..... B08B 13/00

[52] U.S. Cl. ..... 134/57 D; 134/58 D; 134/108; 200/84 B; 200/190

[58] Field of Search ..... 134/105, 107, 108, 57 D, 134/58 D; 200/84 R, 84 B, 190

[56] References Cited

U.S. PATENT DOCUMENTS

| | | | |
|---|---|---|---|
| 2,701,574 | 2/1955 | Hollerith | 134/57 D |
| 3,610,271 | 10/1971 | Jarvis | 134/57 D |
| 3,829,636 | 8/1974 | Scott | 134/57 D X |
| 3,885,580 | 5/1975 | Cushing | 134/57 D |
| 3,894,555 | 7/1975 | Payne | 134/57 D |

FOREIGN PATENT DOCUMENTS

| | | | |
|---|---|---|---|
| 213331 | 3/1958 | Australia | 134/57 D |
| 1342663 | 9/1963 | France | 134/57 D |
| 54-123265 | 9/1979 | Japan | 134/57 D |
| 1157295 | 7/1969 | United Kingdom | 134/57 D |

*Primary Examiner*—Frankie L. Stinson
*Attorney, Agent, or Firm*—Kokjer, Kircher, Bowman & Johnson

[57] ABSTRACT

A conveyor dishwashing machine in which racks of dishes are conveyed from a loading surface through a hood which presents washing and rinsing zones and onto a discharge surface. In the washing zone, wash spray is applied to the dishes from a spray system which is easily removed for cleaning and easily replaced in the proper position. In the rinsing zone, a rinse curtain applies an initial rinse and creates a barrier against the wash spray. A final rinse of clean city water is applied subsequent to the rinse curtain. Automatic controls operate the machine with a minimum of human intervention.

1 Claim, 5 Drawing Sheets

254
252
250
260
261
258
256
262
264
266
256
30

12
18
60
62
56
68
70
64
66
232
270
228
232
272
12
274
22
206
222
50
38
206
212
220
216
26
112
48
154
13
14
48
24
114
50
114
158
152
132
20
114
160
48
50
114
156
128
130
252
48
122
22
146
142
148
150
12
16
12

DISHWASHING MACHINE AND METHOD

This is a division of application Ser. No. 07/815,500, filed Dec. 30, 1991 still pending.

BACKGROUND OF THE INVENTION

This invention relates generally to the cleaning of dishes and deals more particularly with a dishwashing machine that is useful primarily in restaurants or institutions having a need to wash large quantities of dishes.

In restaurants and institutions which serve large volumes of food, conveyor type dishwashing machines are often used for washing of dishes, glasses and silverware. In conveyor type machines, the dishes are loaded in racks which are conveyed one at a time through a washing zone and then through a rinsing zone prior to being deposited on a discharge table which holds the clean dishes. In the washing zone, heated and/or chemically treated wash water is sprayed onto the dishes to remove food particles from the dishes. In the rinsing zone, the dishes are rinsed by chemically treated (low energy) or heated water (high energy) to remove the residues from the washing operation and sanitize the dishes.

As can easily be appreciated, it is highly important for the dishes to be thoroughly cleaned. If dishes are not completely clean when served to restaurant patrons, the reputation of the restaurant can suffer considerable damage and its business can deteriorate as a consequence. As can also be easily appreciated, it is important to limit the involvement of workers in the operation of the machine, both to minimize labor costs and because poorly trained employees can damage the machine and perhaps put it out of service at an inopportune time.

The conveyor dishwashing machines that have been available in the past have suffered from a number of shortcomings, most notably in their inability to consistently achieve thorough cleaning of dishes, their inability to operate reliably without frequently breaking down or requiring maintenance, and in their relatively high operating costs which are due in large part to the need for large amounts of hot water.

Typically, the machines that have been available in the past have made use of flexible curtains and the like to provide a barrier between the wash compartment and the rinse compartment. Curtains and other types of barriers are subject to becoming coated with food deposits and other contaminants which can contaminate the dishes as they move into the rinse compartment. This can result in the dishes emerging from the machine with contaminants still on them.

Although it is common for machines to have sensors for detecting when the water level is unduly low, the sensors that have been employed in the past have not been reliable. Probes which are immersed in the water are exposed to calcium and other minerals that can build up on the probe and make it unable to accurately sense the water level. Float switches have typically used plastic floats which can be damaged by the high temperature water, the chemicals it contains, or food scraps and other debris that can be present in the water. Reed switches and other electrical switches typically require printed circuit board controls and other electronic components which are both costly and subject to attack by chlorine vapors and other chemical agents that may be in the area. All of the liquid level sensors require frequent replacement and are subject to excessive maintenance requirements. If the sensors should fail to sense an abnormally low liquid level, the consequences can be severe in that the pump and heating elements can be destroyed and necessitate costly repairs and lengthy machine down time.

Another problem is that the food scraps in the wash water can be sucked into the pump and clog it up or otherwise damage it. Even though screens and other filters are normally used to avoid this problem, operators often neglect to make sure that the filter is in place. A further problem results if racks of clean dishes are not removed promptly from the discharge table. The racks can then back up and completely fill the discharge table, and the conveyor continues to attempt to convey more racks through the machine, which can cause damage to the racks and/or the conveyor mechanism.

In order to maintain the machine in a sanitary condition, it is necessary to drain it and clean it as often as twice a day. The spray arms must be removed and cleaned, and their end caps must be removed so that the interior of each spray arm can be cleaned. Existing machines are characterized by difficulty and excessive time consumption in assembling and disassembling the spray components, and this increases the labor costs and the time the machine is out of service while being cleaned. Another problem is that the end caps of the spray arms are often lost while they are detached from the spray arms during the cleaning procedure. Again, this detracts from the efficiency of the machine because it increases the time it is unavailable for use while the end cap is being located or replaced.

SUMMARY OF THE INVENTION

The present invention is directed to a machine for washing dishes more thoroughly and efficiently than has been possible in the past and which limits operator involvement to minimize labor costs and the chance for problems caused by human error. The invention is particularly characterized by automatic controls which allow the machine to operate automatically and which are simple and reliable to avoid the maintenance problems that plague other machines.

In accordance with the invention, a reciprocating conveyor bar carries pivotal dogs which convey dish racks from the loading table through a washing compartment and a rinsing compartment onto a discharge table. In the washing compartment, wash water is sprayed onto the dishes in a controlled pattern which thoroughly cleans the dishes and yet minimizes spreading of the wash spray so that extraneous spraying of the water into the rinse compartment is minimal.

It is a particular feature of the invention that the dishes are conveyed through a low pressure rinse curtain as they enter the rinse compartment. The curtain of rinse water rinses the wash water residue from the dishes and at the same time acts as a barrier to prevent the wash water from infiltrating into the rinse compartment. In the rinse compartment, the dishes are subjected to a final rinse of clean incoming water to assure thorough rinsing of the dishes.

The water in the machine follows a drainage path that is generally opposite to the direction of the conveyor movement. The incoming final rinse water displaces some of the previous rinse water which in turn flows into the wash compartment where it displaces a like amount of wash water into the drain. Consequently, each area of the machine is supplied with cleaner water during each cycle.

Both the collection tank in the wash compartment and the tank in the rinse compartment are equipped with unique liquid level sensing systems. A hollow stainless steel cylinder is immersed in each tank and is connected with an actuator rod. When the liquid level in the tank is abnormally low, the net downward force on the rod is increased because the cylinder is partially out of the water. A microswitch which the actuator rod linkage controls then disconnects power from the heater to prevent it from being damaged, and the switch also opens the valve that admits incoming water to refill the machine. The use of a hollow member constructed of a corrosion and chemically resistant metal such as stainless steel prevents minerals and chemicals in the water from effecting its sensitivity. Consequently, the level sensing system operates reliably in a trouble free manner.

The invention is also characterized by the provision of sensor bars on the conveyor guide rails to sense when a rack is in the wash compartment or rinse compartment and operate the controls accordingly without the need for timers or other complicated controls that are subject to malfunction. When a rack enters the wash area, the sensor bar turns on the conveyor and the pump of the washing system. When the rinse compartment is subsequently entered, the other sensing bar maintains the conveyor energized and turns on the pump for the rinse curtain. It also activates a time delay relay which initiates the final rinse at the proper time. The controls are automatic and do not rely upon human intervention to properly operate the machine. The controls are also simple and economical, easy to service when necessary, resistant to moisture and chemical contamination, and they are factory adjusted so that it is not necessary to adjust them in the field where errors are possible.

The conveyor drive system is equipped with a unique slip clutch which effectively disconnects the conveyor motor from the conveyor bar when the discharge table is full of dish racks. Other features of the invention include a combination filter and plug unit which prevents the wash compartment pump from operating without the filter in place, a unique latch arrangement for the spray manifolds which permits them to be quickly and easily removed and installed following cleaning, and a captive end cap for each spray arm that avoids end cap loss during cleaning of the spray components.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figures 1, 11:
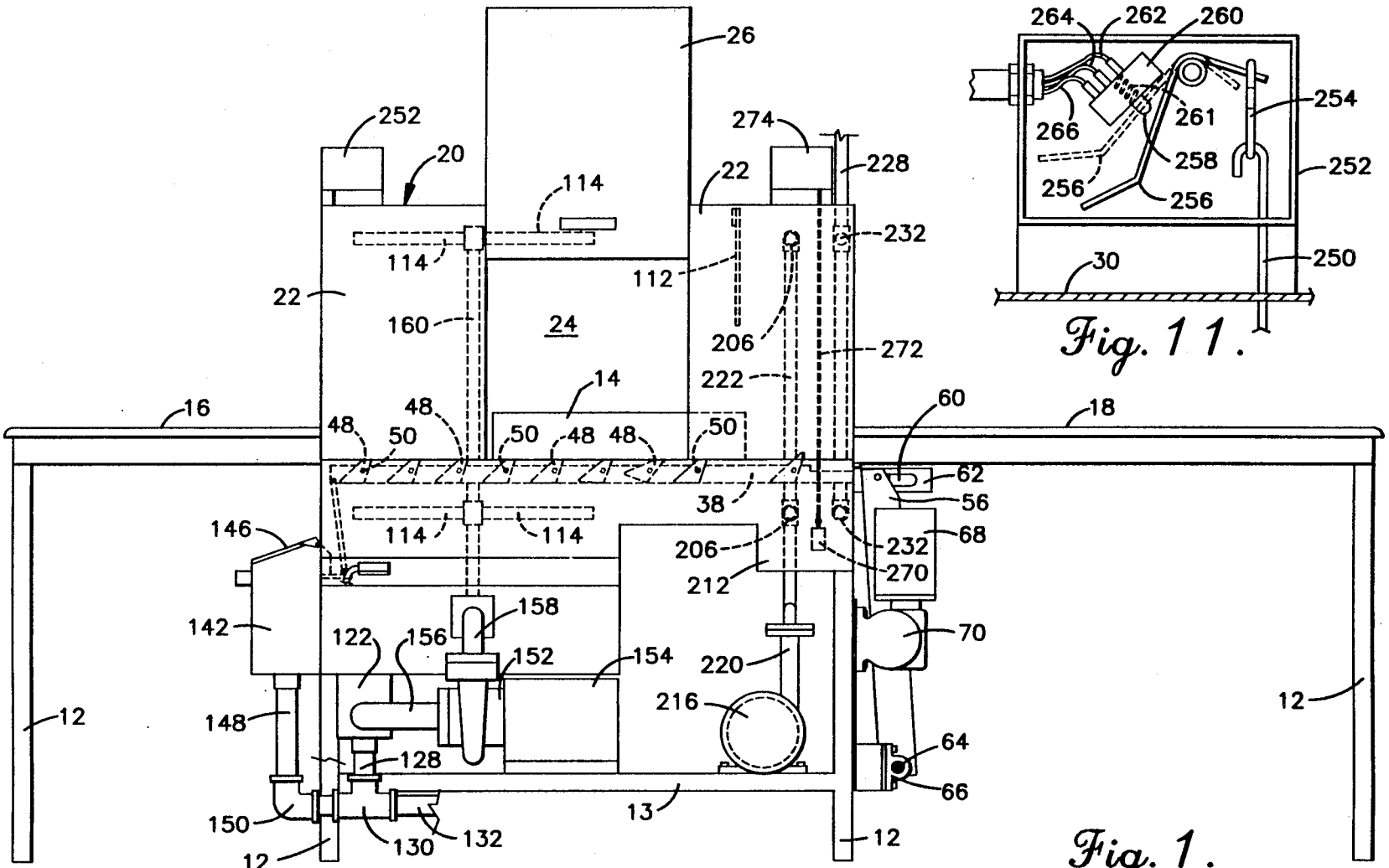
FIG. 1 is a front elevational view of a dishwashing machine constructed according to a preferred embodiment of the present invention and showing a dish rack being conveyed through the machine.
FIG. 11 is a sectional view on an enlarged scale taken through the switch box for one of the micro switches of the liquid level sensing system, with the broken line view cf the switch actuator illustrating the position when the liquid level is abnormally low.

Referring now to the drawings in more detail and initially to FIG. 1 in particular, a dishwashing machine constructed in accordance with the present invention is generally identified by numeral 10. The machine 10 has a rigid frame which includes a plurality of legs 12 arranged in pairs located near the front and back sides of the machine. A mounting panel 13 is provided near the bottom ends of the center pairs of legs to support motors and other machine components. As viewed in FIG. 1, the left side of the machine 10 is the loading end at which dishes that are to be washed by the machine are received. The dishes are loaded in dish racks 14, and the racks are initially loaded on a loading table 16 at the loading station. The right end of the machine is the discharge end at which clean dishes are discharged from the machine. A discharge table 18 at the discharge end receives the racks containing dishes that have been washed by the machine. It is noted that the loading table 16 and discharge table 18 need not necessarily be provided as part of the machine. The machine can have a configuration that is a mirror image of what is shown for use in a situation where right to left conveying is necessary or desirable.

Figure 2:
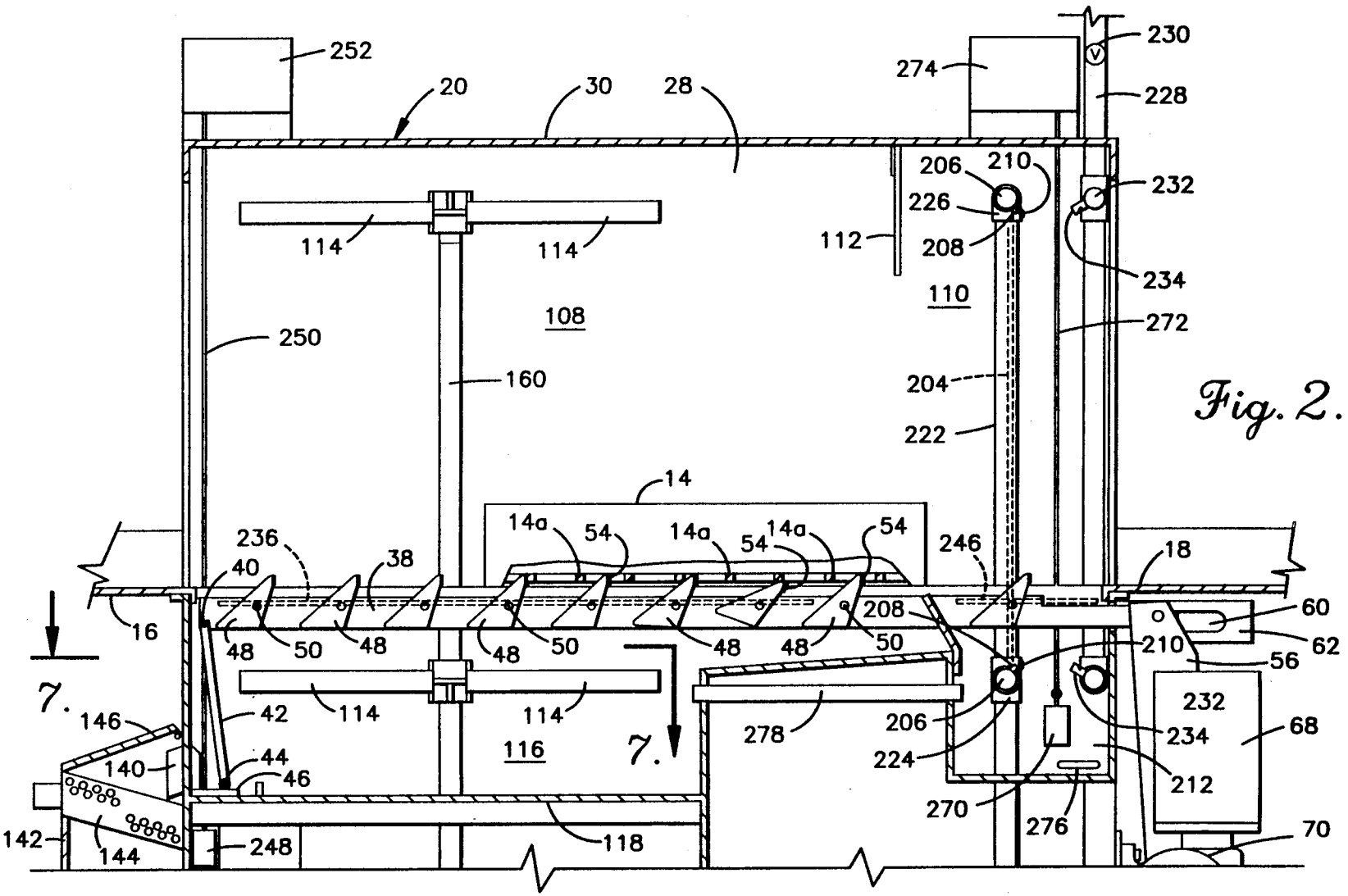
FIG. 2 is a fragmentary front sectional view taken through the machine on a vertical plane and on an enlarged scale, with portions broken away for purposes of illustration.
Figure 5:
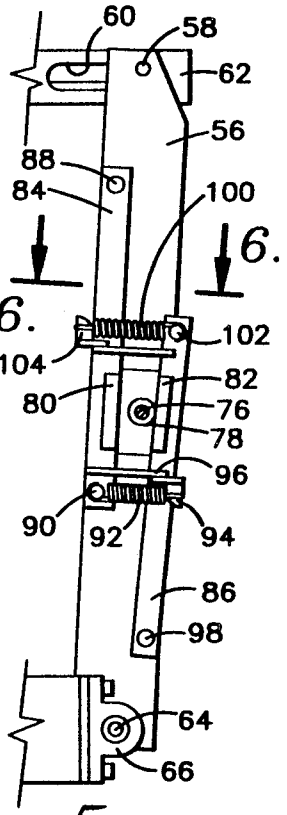
FIG. 5 is a fragmentary sectional view similar to FIG. 4, but showing the clutch of the conveyor drive system in a slipped condition due to the discharge table of the machine being filled with dish racks.

The dishes in the rack 14 are washed and rinsed in a hood which is generally identified by numeral 20 and which is located between the loading table 16 and the discharge table 18. The hood 20 is open at its left and right ends and includes a pair of spaced apart front panels 22 which define an access opening 24 between them providing access to the interior of the hood. A sliding door panel 26 normally closes the access opening 24 but can be slid upwardly to the position shown in FIG. 1 to expose the access opening 24 and thereby provide access to the interior of the hood from the front of the machine. As best shown in FIG. 2, the hood 20 also includes a back panel 28 and a top panel 30 which extends between the front panels 22 and the back panel 28. Preferably, the panels which form the hood 20 are constructed of stainless steel or another material that is resistant to high temperatures, corrosion and the types of chemicals that are used in the sanitization of dishes.

Figure 7:
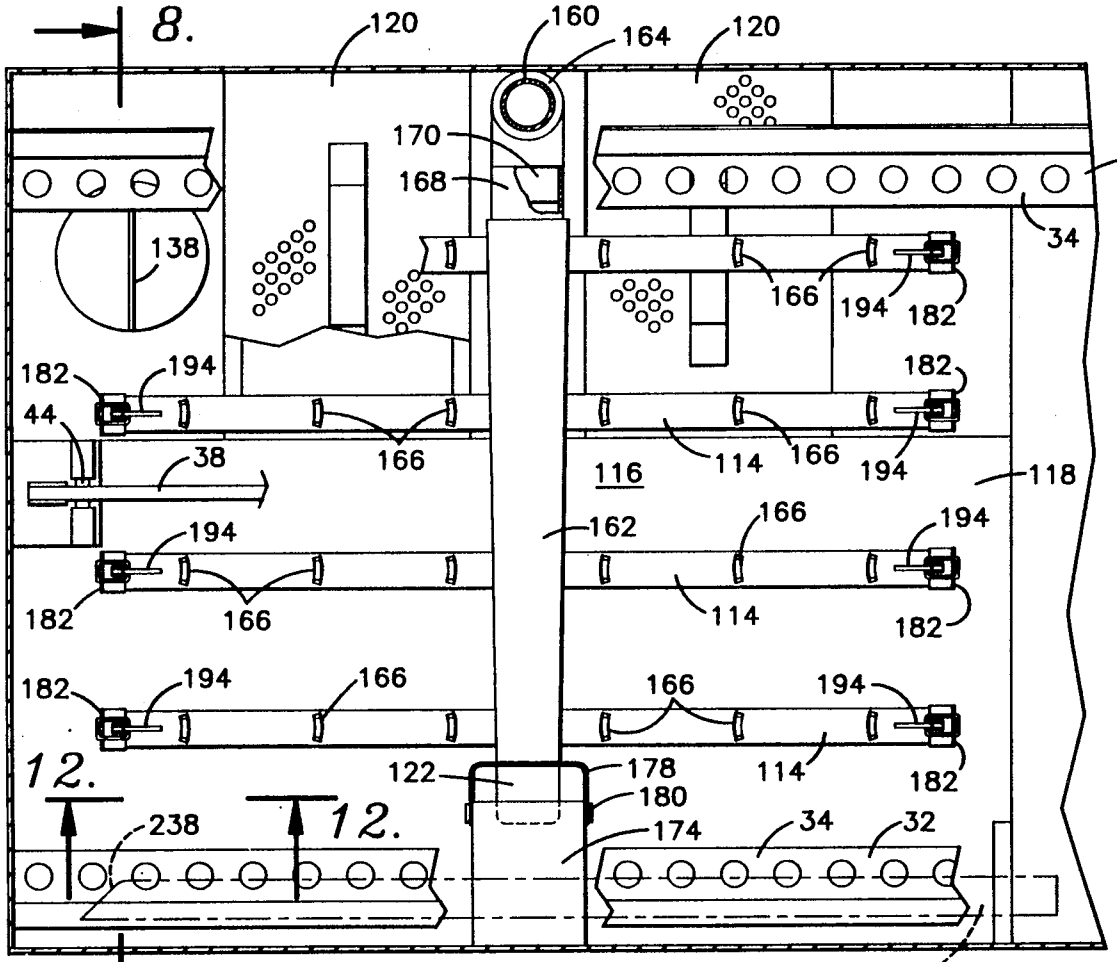
FIG. 7 is a fragmentary sectional view on an enlarged scale taken generally along line 7—7 of FIG. 2 in the direction of the arrows, with portions broken away for purposes of illustration.
Figure 8:
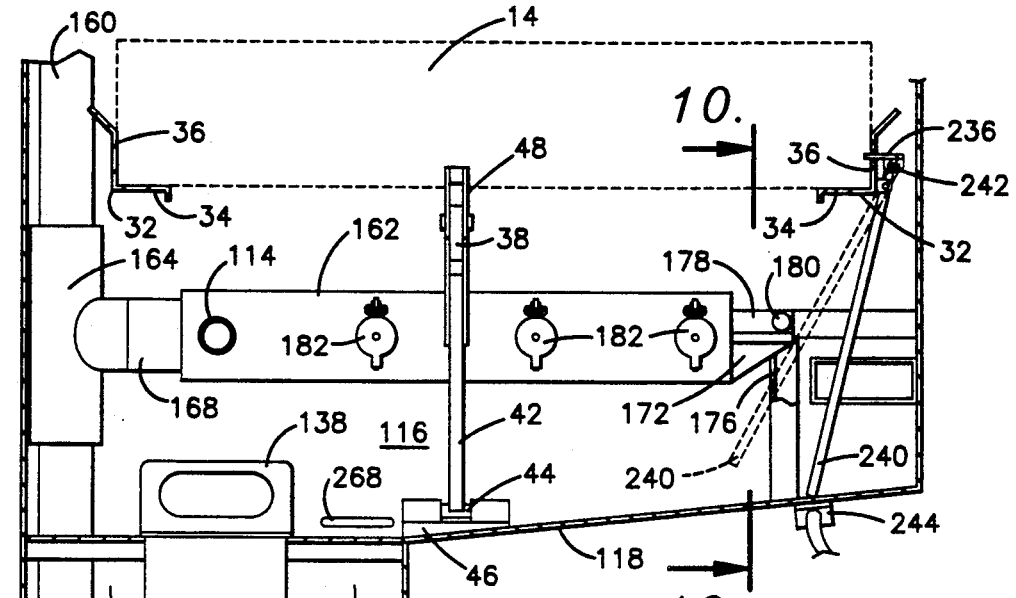
FIG. 8 is a fragmentary sectional view taken generally along line 8—8 of FIG. 7 in the direction of the arrows, with the broken line view of the rack position sensor switch arm showing the arm tripped to indicate the presence of a dish rack in the wash compartment of the machine.

As best shown in FIGS. 7 and 8, a pair of parallel conveyor rails 32 extend through the hood 20 from the loading table 16 to the discharge table 18. With particular reference to FIG. 8, each rail 32 has a horizontal shelf 34 which provides a support surface for the racks 14. Extending upwardly from the shelf portion 34 of each rail 32 is a vertical guide surface 36 which fits against the side of the rack 14 and which terminates in an outwardly flared flange at its top end.

Referring now to FIG. 2 in particular, the dish racks 14 are conveyed in succession through the hood 20 by a conveyor system which includes a reciprocating conveyor bar 38 located approximately midway between the conveyor rails 32. The left end of the conveyor bar 38 is pivoted at 40 to the top end of a rocker arm 42 having its bottom end pivoted at 44 in bushing blocks 46 which are secured to the pan of the machine. The conveyor bar 38 carries a plurality of spaced apart dogs 48, each of which is pivotally secured to the bar 38 by a pivot coupling 50. The dogs 48 are provided at their upper ends with small pusher plates 54 which act against the dish racks 14 as will be explained more fully. The pusher plates 54 also limit the pivotal movement of the dogs in a counterclockwise direction as viewed in FIG. 2.

The conveyor bar 38 is reciprocated generally lengthwise by a conveyor drive system which includes a generally upright pivot lever 56 having its top end pivoted at 58 to the back or right end of the conveyor bar 38. The pivot bolt 58 fits through a slot 60 which is formed in a guide 62. The pivot bolt 58 is thus restricted to movement within the confines of the slot 60 as the conveyor bar 38 is reciprocated, and the opposite end of the conveyor bar is controlled in its movement by the rocker arm 42.

With reference additionally to FIGS. 3–6, the lower end of the pivot lever 56 is provided with a horizontal shaft 64 which is supported to rotate by a pair of bearings 66 secured to the frame. The shaft 64 provides a horizontal pivot axis about which the pivot lever 56 is reciprocated.

The pivot lever 56 is driven by an electric motor 68 which is connected through reduction gearing 70 with a cylindrical coupling 72. The reduction gearing 70 drives an output shaft 74 which is coaxial with the coupling 72 and which drives the coupling 72 rotatively about the axis of the shaft 74. The opposite or output side of the coupling 72 is provided with an eccentric shaft 76 which is displaced from the longitudinal axis of the coupling and which therefore travels in a small circle about the center of the axis 74.

The eccentric shaft 76 carries a bearing 78 which fits closely between a pair of wear blocks 80 and 82 projecting from respective pivot bars 84 and 86. The pivot bars form part of a slip clutch mechanism which forms part of the drive train between the motor 68 and the conveyor bar 38. Bar 84 is pivoted at its top end to the pivot lever 56 by a pivot pin 88. The lower end of bar 84 is provided with a pin 90 to which one end of a tension spring 92 is hooked. The opposite end of spring 92 is hooked to a lug 94 secured to lever 56. Bar 84 is thus mounted to pivot on lever 56 about the axis of pin 88 and is normally retained by spring 92 in the position shown in FIG. 4. A guide 96 guides the pivotal movement of bar 84 and holds it close to lever 56.

The other bar 86 is similarly mounted on the pivot lever 56. A pivot pin 98 pivots the lower end of bar 86 to lever 56, and a tension spring 100 is hooked at one end to a pin 102 projecting from the top end of bar 86. The opposite end of spring 100 is secured to a lug 104. Bar 86 is able to pivot about the axis of pin 98 and is normally held in the position shown in FIG. 4 by the tension spring 100. A guide 106 holds bar 86 closely against the side of the pivot lever 56.

The two springs 92 and 100 are relatively stiff, and the force applied by the eccentric shaft 76 to the blocks 80 and 82 is normally transmitted to the pivot lever 56 through the bars 84 and 86 and the springs 92 and 100. Thus, the path of the eccentric shaft 76 drives the top end of lever 56 to the right during one-half of each cycle and to the left during the remaining one-half of each cycle. Consequently, the conveyor bar 38 is reciprocated to the right during one-half of each cycle and to the left during the remaining one-half of each cycle.

Referring now to FIG. 2 in particular, the interior of the hood 20 presents a washing zone or compartment 108 adjacent to the inlet end of the hood and a rinse zone or compartment 110 adjacent to the discharge end of the hood. Between the two compartments 108 and 110, a flexible rubber curtain 112 hangs downwardly from the top panel 30 of the hood. The lower end of the curtain 112 is spaced well above the dish racks 14 in the hood to avoid contact with any dishes carried by the racks.

Chemically treated wash water is applied to the dishes in the washing compartment 108 by a plurality of spray arms 114 which are arranged in two banks, one located above and the other located below the dish racks 14 which are conveyed through the hood. Below the lower spray arms 114, a wash water collection tank 116 is provided to collect the wash water that is sprayed on the dishes. The floor 118 of the tank 116 slopes downwardly from the front of the machine toward the back to direct the wash water which collects in the tank 116 toward a pair of removable screen filters 120 (see FIG. 7). The wash water drains through the screens 120 into a sump 122 at the bottom of tank 116, and the screens 120 filter out large scraps of food and other debris. The screens 120 can be removed for disposal of debris collected on them.

With continued reference to FIG. 8, the bottom of the sump 122 is provided with a cylindrical outlet 124 having a drain fitting 126 at its bottom end. The drain fitting 126 connects with a short pipe 128 which connects at its lower end with a tee fitting 130 (see FIG. 1). The tee fitting 130 in turn connects with a drain pipe 132 which leads to a drain (not shown).

The drain fitting 126 is normally closed by a plug 134 formed as part of a cylindrical filter screen 136 which fits closely in the sump outlet 124. The top end of the screen 136 projects upwardly above the sump 122 and is equipped with a handle 138 to facilitate removal of the screen and its replacement. It is noted that when the filter screen 136 is in place in the sump outlet 124, the plug 134 is automatically in place in the cutlet fitting 126 to prevent water in the sump 122 from draining into the drain system. Conversely, when the screen 136 is removed from the sump outlet 124, the drain plug 134 is removed from the outlet fitting 126, and any water in the sump and tank 116 then quickly drains away. Preferably, the mesh openings in the filter screen 136 are smaller than those in the screens 120 so that the screen 136 is able to filter out smaller particles that may be able to pass through screens 120.

As best shown in FIG. 2, the wash water tank 116 has an overflow outlet 140 which automatically drains water from the tank when it rises to the level of the overflow opening 140. The overflow opening 140 opens into a box 142 equipped with a removable screen filter 144. The box 142 has a hinged cover 146 which may be opened to provide access for removal of the screen 144. The overflowing water which passes through the screen 144 drains into a pipe 148 (see FIG. 1) which connects through an elbow 150 with the drain fitting 130. Consequently, the water which overflows from the tank 116 is filtered through the screen 144 and then drains away.

Water is delivered from the sump 122 to the spray arms 114 by a pump 152 driven by an electric motor 154. The pump 152 has an intake line 156 which connects with the side of the sump outlet 124 such that all water entering the intake line 156 must first pass through the filter screen 136. The pump 152 has a discharge line 158 which connects with a vertical riser pipe 160. The lower spray arms 114 are connected with a common manifold pipe 162 which connects with the riser pipe 160 through a tee fitting 164.

Figure 12:
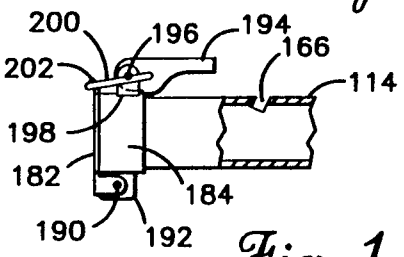
FIG. 12 is a fragmentary sectional view on an enlarged scale taken generally along line 12—12 of FIG. 7 in the direction of the arrows and showing the end cap of the spray arm in place.
Figure 13:
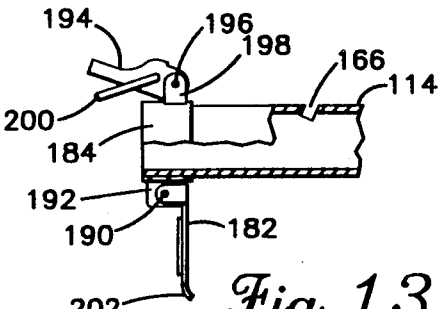
FIG. 13 is a fragmentary sectional view similar to FIG. 12, but showing the end cap unlatched and swung open.
Figure 9:
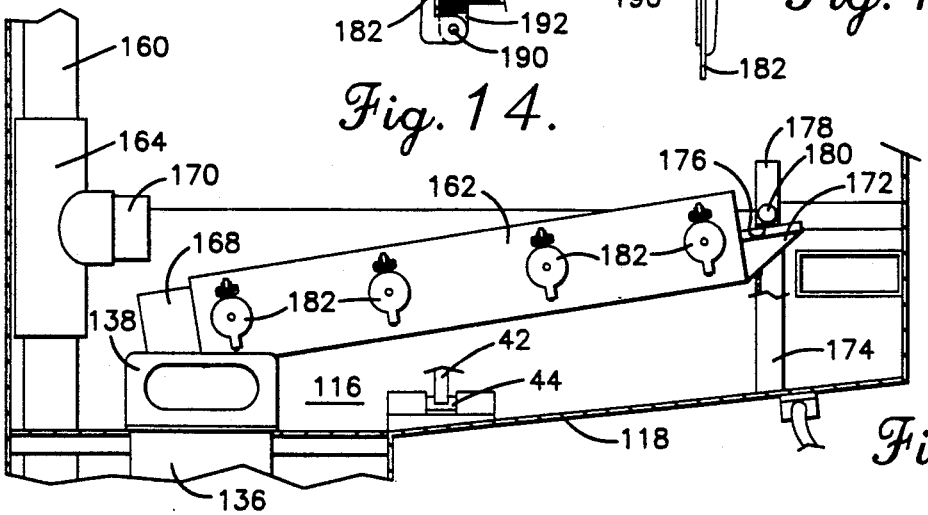
FIG. 9 is a fragmentary sectional view similar to FIG. 8, but showing the lower spray arm manifold partially removed from the machine.

As best shown in FIGS. 7–9, four of the spray arms 114 extend laterally from each side of the manifold pipe 162. Each spray arm 114 is provided with three outlet slots 166 which are spaced apart along the length of the spray arm. The slots 166 in the lower spray arms 114 are formed in the top portion of each spray arm in order to spray the wash water generally upwardly toward the dishes in the overlying dish rack 14. The outlet slots 166 in the upper spray arms 114 are located in the bottom portions of the arms in order to direct the wash water spray generally downwardly toward the dishes in the underlying dish rack. As shown in FIGS. 12 and 13 in particular, each slot 166 is offset from vertical by an angle of about 25°. The angled nature of each slot causes the spray to be directed inwardly somewhat as well as upwardly or downwardly. By providing outlet slots 166 rather than individual spray tips on the spray arms, the pattern of application of the wash water to the dishes is accurately controlled to effectively wash the dishes and to minimize the extraneous spray of wash water and prevent it from spreading unduly to possibly ricochet or otherwise infiltrate into the rinsing zone 110.

The manifold 162 has a special detachable connection with the tee fitting 164. The inlet end of the manifold pipe 162 is open and presents a cylindrical collar 168 which fits closely around a small cylindrical extension 170 secured in the lateral outlet of the tee fitting 164. When the collar 168 is fully applied to the fitting 170 as shown in FIGS. 7 and 8, its free end butts against the end of the lateral outlet of the tee fitting and fully surrounds the extension 170.

Figure 10:
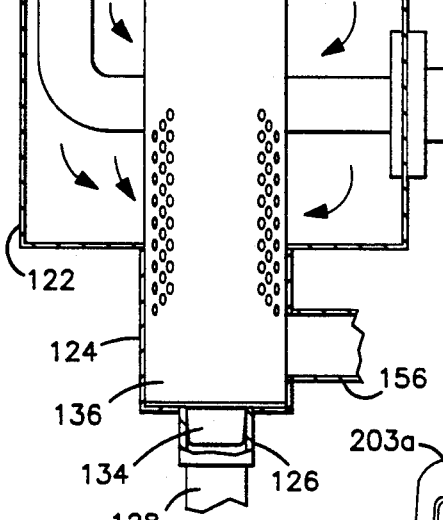
FIG. 10 is a fragmentary sectional view on an enlarged scale taken generally along line 10—10 of FIG. 8 in the direction of the arrows.
Figure 10:
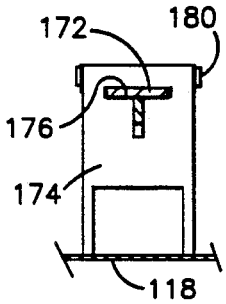

The end of the manifold pipe 162 opposite the inlet end is a closed end which is provided with a projecting lug 172 having a T shape in cross section (see FIG. 10). A mounting block 174 secured to the frame of the machine is provided with a T shaped slot 176 (FIG. 10) having a size and shape complemental to the lug 172. A pivotal bail 178 is mounted on the block 174 to pivot about a pin 180 between a latching position of the manifold pipe 162 (see FIGS. 7, 8 and 10) and a release position (FIG. 9). In the latching position of the bail, its end butts against the closed end of the manifold pipe 162 and thereby locks the collar 162 in place in abutment against the end of the lateral outlet of the tee fitting 164. In the release position of the bail 178, it is swung upwardly and released from the closed end of the manifold pipe 162. The manifold pipe can then be slid forwardly with the lug 172 moving further into the slot 176, thus allowing the collar 168 to clear the end of extension 170 so that the inlet end of the manifold pipe can be detached from the tee fitting 164, as shown in FIG. 9. The manifold pipe can then simply be pulled away from block 174 at an angle to remove the lug 172 from slot 176 and free the manifold pipe for removal from the machine and cleaning of the spray arms 114. The manifold can be replaced after cleaning by first inserting the lug 172 into slot 176 with the bail 178 in the release position to allow the lug to move deeply into the slot, and then aligning the collar 168 with the extension 170 before slipping the collar onto the extension. When the bail 178 is then swung downwardly to the latching position, it securely holds the manifold pipe and the spray arms 114 in place in the machine.

In this manner, the manifold pipe and spray arm assembly can be quickly and easily removed from the machine as a unit, cleaned, and replaced in the machine as a unit. It is noted that the T shaped configuration of the lug 172 and the slot 176 allows the lug to fit in the slot in only one rotative orientation of the manifold pipe Consequently, the workers who are removing and replacing the manifold assembly are unable to install the assembly in an improper orientation that could result in ineffective application of the wash spray.

Each spray arm 114 has a closed outer end equipped with a captive end cap 182 which may be opened to expose the end of the spray arm for cleaning of its interior. As best shown in FIGS. 12 and 13, the outer end of each spray arm is provided with an enlarged collar 184. The end cap 182 is pivotally connected at 190 to a lug 192 projecting from the collar 184. The end cap 182 can swing about the pivot axis 190 from the closed position shown in FIG. 12 where it closes the end of the spray arm 114 and the fully open position shown in FIG. 13 where the end of the spray arm is open to provide access for cleaning of its interior.

A pivotal latch 194 is pivoted at 196 to a lug 198 which projects from the collar 184 at a position diametrically opposite lug 192. A latching bail 200 is pivoted to the latch 194. When the end cap 182 is swung to the closed position, the bail 200 can be hooked on a curved tab 202 on the end cap, and the latch 194 can then be swung to the latching position of FIG. 12 in order to securely latch the end cap 182 in the closed position. The latch 184 can be swung about pin 196 to the position shown in FIG. 13, and the bail 200 is then released from the tab 202 to unlatch the end cap 182 and permit it to be swung to the open position.

It is to be understood that the manifold pipe mounting arrangement disclosed for the manifold of the lower spray arms 114 is also used for the manifold pipe associated with the upper spray arms 114. Similarly, all of the upper spray arms 114 are equipped with captive end caps 182. It is noted that the end caps 182 are permanently connected pivotally with their spray arms and they are therefore not susceptible to becoming lost or misplaced when the ends of the spray arms are opened during the cleaning procedure.

Figure 14:
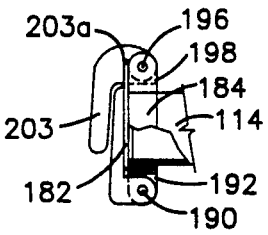
FIG. 14 is a fragmentary side elevational view showing the end of the spray arm equipped with an alternative latch for the end cap, with the cap latched and portions shown in section for purposes of illustration.
Figure 15:
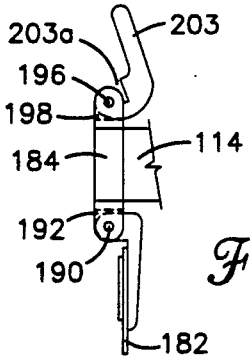
FIG. 15 is a fragmentary side elevational view similar to FIG. 14, but showing the end cap unlatched and swung open.

FIGS. 14 and 15 depict an alternative latch for the end caps 182. A cam type latch 203 is pivoted to lug 198 by pin 196. Latch 203 differs from latch 194 in that instead of the bail 200, latch 203 has a slot 203*a* located and arranged to receive the edge of cap 182 when the latch 203 is swung to the latched position of FIG. 14. When latch 203 is swung to the unlatched position of FIG. 15, it releases the end cap and the cap can then be pivoted open to expose the interior of the spray arm 114. Latching of the end cap is accomplished by swinging it to the closed position on the spray arm and then pivoting the latch 203 to its latching position. As the latch approaches the fully latched position, slot 203*a* fits on the edge of the end cap 182 gradually. As the latch continues to pivot, it presses and holds the end cap against the end of the spray arm by camming action. When the latch is fully latched, the edge of the end cap fits fully in the slot 203*a* and the latch can be released only if it is forcefully pivoted to displace the slot 203*a* from the edge of the end cap. In this manner, the camming latch 203 is able to effectively hold the end cap in place and yet is releasable when access is needed to the spray arm interior.

Figure 3:
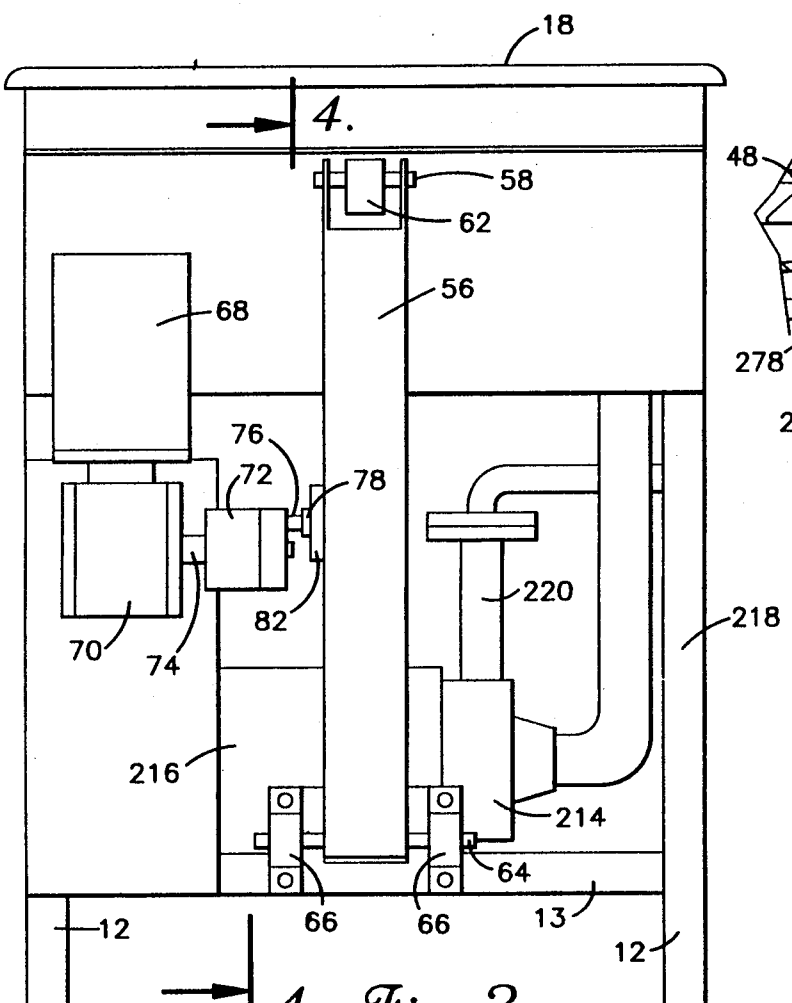
FIG. 3 is an end elevational view on an enlarged scale taken from the right end of FIG. 1.
Figure 6:
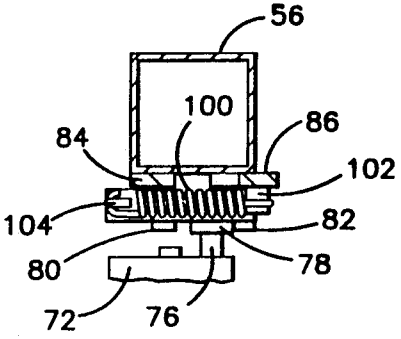
FIG. 6 is a fragmentary sectional view on an enlarged scale taken generally along line 6—6 of FIG. 5 in the direction of the arrows.

In the rinse compartment 110, the dishes are conveyed through a rinse water curtain which is generally identified by numeral 204 in FIG. 2 and which is created by rinse water pumped through upper and lower pipes 206 and discharged through nozzles 208 directed toward associated deflectors 210. The rinse water is collected in a tank 212 which generally underlies the rinse compartment 110 and which extends from front to back across the width of the machine. As best shown in FIG. 3, a pump 214 is driven by an electric motor 216 and is supplied with incoming rinse water through an intake pipe 218 extending downwardly from the tank 212. A discharge pipe 22 extends from the discharge side of the pump 214 and connects with a vertical riser pipe 222. The riser pipe 222 connects with the lower supply pipe 206 through a tee fitting 224 and with the upper supply pipe 206 through an elbow 226.

The nozzles 208 are spaced generally uniformly along the length of each supply pipe 206. The nozzles for the upper pipe 206 point generally downwardly and to the right at an angle of about 45°, and the nozzles for the lower supply pipe point upwardly and to the right at the same 45° angle. One of the deflectors 210 is mounted adjacent to each nozzle 208 and is located and oriented to direct the water that discharges from the nozzles 208 in a vertical direction, either straight downwardly or straight upwardly depending upon whether the deflector is mounted on the upper pipe or the lower pipe. The pattern of the water discharging from the pipes 206 thus forms the water curtain 204 which is in a substantially vertical plane and is located in the rinse compartment 110 between the curtain 112 and the discharge table 18.

A final rinse of clean incoming city water is provided in the rinse compartment 110 at a location downstream from the water curtain 104. A supply pipe 228 which connects with a suitable water supply such as a city water supply is equipped with a solenoid valve 230 (see FIG. 2) and connects with upper and lower pipes 232 located above and below the dish racks moving through the rinse compartment. Each pipe 232 is provided with a plurality of spray nozzles 234 which are spaced apart along the length of each pipe 232. The spray nozzles 234 apply the final rinse water to the dishes in the rack that is being conveyed through the hood 20.

The sequence and timing of the machine operations are controlled automatically, and reliance is not placed upon human intervention. Referring particularly to FIGS. 7 and 8, the position of a dish rack in the wash compartment is sensed by a sensing system that includes an elongated bar 236 which projects through the vertical guide surface 36 of one of the conveyor rails 32 in order to be tripped by a rack 14 located in the wash compartment 108. The leading end of the bar 236 is beveled at 238 so that the rack does not catch on the bar but instead deflects it as the rack first encounters the bar.

As shown in FIG. 8, an elongated switch actuating arm 240 is pivoted to the bar 236 at its top end and is also pivoted slightly below its top end to a lug 242 projecting from the conveyor rail 32. When a rack is not present to deflect the bar 236, the weight of the arm 240 retains it in the position shown in solid lines in FIG. 8. Then, the free end of the arm 240 is located adjacent to a magnetic switch 244 mounted to the underside of panel 118. The proximity of the arm 240 to this magnetic switch 244 maintains the switch in an open condition in which electric power is unavailable to the conveyor drive motor 68 or to the wash water pump 152. However, when a rack is in position to deflect bar 236, the switch arm is pivoted to the position shown in broken lines in FIG. 8 where its free end is displaced well away from switch 244. Switch 244 is then in a closed condition in which power is applied to the conveyor motor 68 and to the pump 152, thus energizing the conveyor and the wash spray system.

The rinse compartment 110 is equipped with a similar sensing system which includes an elongated bar 246 (FIG. 2) on the conveyor rail 32 at a location within the rinse compartment 110. The bar 246 operates in the same manner as the bar 236 previously described, except that the conveyor motor 68 and the rinse pump 216 are energized whenever the bar 246 is maintained in a tripped position by a dish rack moving through the rinse zone of the machine.

Both the wash water tank 116 and the rinse water tank 212 are equipped with low liquid level sensing systems which detect when the water level in the tank is unduly low and act automatically to prevent damage to the machine components. Referring first to the wash water tank 116, a hollow stainless steel cylinder 248 (FIG. 2) is suspended on a vertical rod 250 which extends upwardly into a switch box 252 mounted on the top panel 30 of the hood. The cylinder 248 is normally totally immersed in the water in the tank. As shown in FIG. 11, a link 254 connects the top end of the rod 250 with a pivotal switch actuator 256. The actuator 256 is normally displaced from a plunger 258 which projects from a microswitch 260, and the plunger 258 is thus normally extended due to the action of a small spring 261 which biases the plunger outwardly. The microswitch 260 receives incoming power from a power lead 262. When the plunger 258 is in its normally extended position, the power lead 262 connects with additional lead wires 264 and 266 which control respective relays for the pump motor 154 and an electric heating element 268 (FIG. 8) located in the tank 116.

When the water level in tank 116 drops sufficiently to expose part of the cylinder to the air, the effective weight of the cylinder increases because it displaces less water. When approximately half of the cylinder is exposed, the water level in tank 116 is at an abnormally low level, and the weight of the cylinder and its linkage is then great enough to overcome the force of the plunger spring 261. Through the linkage of rod 250 and link 254, the switch actuator 256 is pivoted to the broken line position shown in FIG. 11 against the force of spring 261. Then, the plunger 258 is depressed and the electrical connection between the power lead 262 and each of the other lead wires 264 and 266 is interrupted by the microswitch 260. Consequently, when the water level in the tank 116 is unduly low, the heating element 268 is deactivated to prevent the heater from operating in dry conditions and possibly burning out. At the same time, the solenoid valve is opened to admit water for refilling of the wash tank 116.

The hollow cylinder 248 is more fully immersed in the water and thus has less effective weight as the water level in tank 116 rises, and it is less fully immersed and effectively heavier as the water level falls. By way of example, an arrangement that has been found to work well uses a cylinder that (together with its linkage) weighs about 8 ounces in air and about 1 ounce when fully immersed in water. If the force applied by the spring 261 is 4.5 ounces, the cylinder weight is able to overcome the spring force only if the water level drops far enough to expose over ½ of the cylinder. When the water level drops to this unduly low level, the effective weight of the cylinder exceeds the 4.5 ounce force applied by spring 261 and the plunger 258 is depressed as the cylinder drops slightly. If the water level subsequently rises sufficiently that the effective cylinder weight is again less than 4.5 ounces, the spring 261 is able to extend the plunger again to restore the normal operating condition.

The cylinder 248 is unlike the float of a float switch in that it does not float on the water and move up and down with changes in the liquid level. Instead, it is a negatively buoyant device that varies in the extent to which it is immersed in the water but always exerts a net downward force because its weight exceeds the weight of the water it displaces even when it is totally immersed. Its operation is based on the pressure differential resulting from changes in the extent to which it is immersed, and on the relatively fixed force of the plunger spring 261 that the weight must overcome. It has been found that this type of level sensing system is highly accurate and reliable in operation and avoids many problems of other systems. Because the cylinder 248 is constructed of a material (such as stainless steel) that is able to resist corrosion, chemical attack and mineral build up, the liquid level sensing system operates reliably and requires only minimal maintenance. There is enough "play" in the linkage for cylinder 248 to accommodate the changes in the water level that occur in normal operation without activating the microswitch 260.

A similar hollow stainless steel cylinder 270 (see FIG. 1) is suspended in the rinse tank 212 on a rigid metal rod 272 which extends into a switch box 274 mounted on top of the hood 20. The cylinder 270 and the rod 272 function in the same manner previously described for the cylinder 248 and rod 250 in order to sense an unduly low water level in the rinse tank 212. If the water level in tank 212 is unduly low, the microswitch (not shown) in the switch box 274 acts to interrupt power availability to the electric heating element 276 located in tank 212. The solenoid valve 230 opens to admit incoming water to the tank 212 in the same manner as described in connection with the wash tank 116.

In use of the machine, dirty glasses, dishes, eating utensils and the like are loaded into one of the racks 14 located on the loading table 16. When the rack on the loading table is full, the operator pushes it into the hood 20 until the leading end of the dish rack encounters the beveled end 238 of the trip bar 236. At this time, the arm 240 is deflected away from the magnetic switch 244, and the conveyor motor 68 and the pump motor 154 are both energized. The leftover wash water in the tank 116 is heated to the desired temperature by the heating element 268 which is preferably under thermostatic control to maintain the wash water at the desired temperature. The conveyor bar 38 is reciprocated by the conveyor motor and the drive train for the conveyor system, and the dogs 48 are pulled against the cross bars **14*a* of the dish rack as the bar 38 moves to the right during one-half of its operating cycle. During movement of the conveyor bar 38 to the left, the dogs 48 which encounter the cross bars 14*a* are able to deflect about their pivot axes 50 in order to avoid moving the rack to the left. In this manner, the rack 14 is conveyed through the hood 20** at the desired speed.

As soon as one rack 14 has entered the hood, another rack can be positioned on the loading table 16 and loaded with dishware. Alternatively, the loading table 16 can be made long enough to hold a number of racks one behind the other so that more than one rack can be loaded at a time.

In any event, as each rack is conveyed through the washing compartment 108, pump 152 draws the wash water from the tank 116 and sump 122 through the filter screen 124 and pumps it through the riser pipe 160. The water that is pumped through the riser pipe 160 passes into and through the upper and lower manifolds 162 and is discharged against the dishes in the rack as a wash spray from the spray arms 114. The spray arms apply the wash spray from above and below the dish rack to assure thorough cleaning of the dishes in the rack.

As soon as the leading end of the rack 14 encounters the trip bar 246 in the rinse compartment 110, the rinse water pump 216 is energized and pump 214 then pumps water out of the rinse tank 212 and through the riser pipe 222 to the supply pipes 206. The water discharges from pipes 206 to provide the rinse water curtain 204, and the dishes are rinsed as they pass through the water curtain 204.

It is noted that there is a period when both of the trip bars 236 and 246 are tripped at the same time. Thus, the dishes in the trailing part of the dish rack 14 are being washed at the same time as the dishes in the leading part of the rack are being rinsed by the rinse curtain 204. After being rinsed during passage through the curtain 204, the dishes are subjected to a final rinse of clean incoming water which is supplied through pipe 228 and pipes 232 and the nozzles 234. When the trailing portion of the rack 14 clears the bar 236, the other bar 246 is tripped, so the conveyor motor remains energized to continue to convey the rack until its trailing portion clears the trip bar 246, at which time the conveyor stops unless another rack has been placed in the wash compartment.

It is a particularly important feature of the invention that the water curtain 204 provides a barrier which prevents extraneous spray from the wash compartment from infiltrating into and possibly contaminating the cleaner water in the rinse compartment. Thus, once the glasses have passed through the water curtain 204, they are effectively shielded from the relatively dirty water in the wash compartment, and they are then rinsed to a particularly clean state by the final rinse. Preferably, the solenoid valve 230 is operated by a time delay relay which acts to open the valve 230 a preselected time after the bar 246 is tripped and to close the solenoid valve 230 a preselected time after the rack has cleared the bar 246.

The final rinse can be supplied at a water temperature of approximately 140° F. and a pressure of approximately 20 psi. It has been found that a final rinse volume of one gallon per cycle is adequate under most circumstances. The water curtain 204 is supplied at relatively low pressure such as 3 psi.

In this manner, the dishes in successive racks 14 are thoroughly and efficiently cleaned by the machine, and only one gallon of additional water is required per cycle to conserve both water and energy. The water from both the water curtain 204 and the final rinse are collected in the rinse tank 212, and the additional one gallon of water that enters the machine during each cycle is thus initially collected in tank 212. An overflow chute 278 (FIG. 2) which is open at the top extends at a downward incline from the rinse tank 212 to the wash water tank 116, and one gallon is thus drained through chute 278 from the rinse tank to the wash water tank each cycle. Preferably, tank 212 holds about three or four gallons below the overflow chute 278. The water in tank 212 is made cleaner each cycle because one gallon of clean incoming water is added to the previously used rinse water (about three gallons) and most of the water that overflows through the chute 278 is the used rinse water.

The rinse water that is applied through the overflow chute 278 to the wash water tank 116 is cleaner than the water already present in the wash tank. The added water causes the level in the wash tank 116 to rise such that it overflows through the overflow opening 140 and is drained from the machine. The water in tank 116 is thus made cleaner during each cycle because relatively clean incoming water displaces relatively dirty water.

Figure 4:
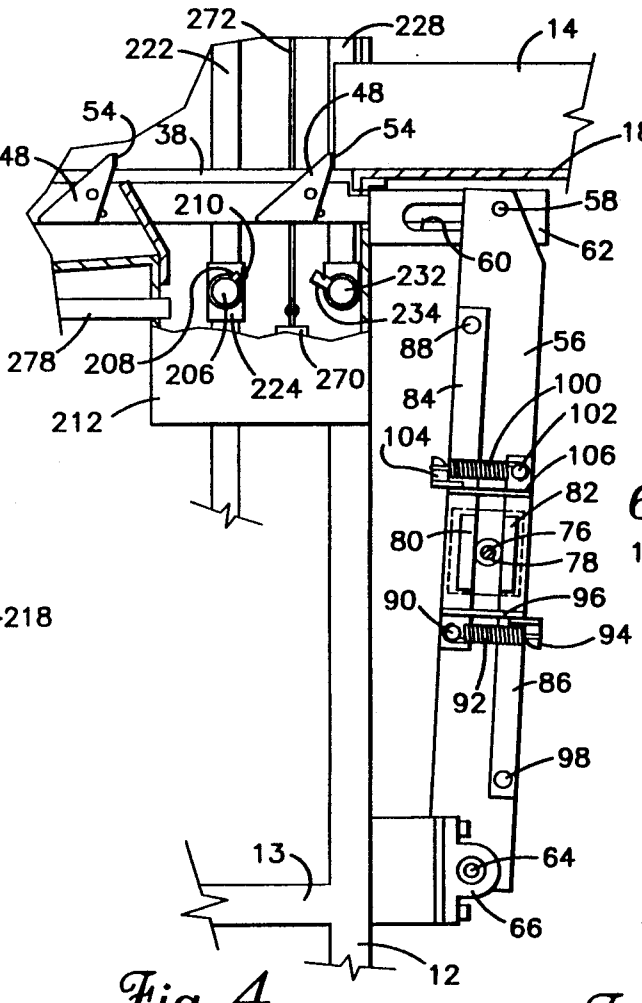
FIG. 4 is a fragmentary sectional view taken generally along line 4—4 of FIG. 3 in the direction of the arrows.

In the event that the discharge table 18 is full of racks of clean dishes, the slip clutch mechanism in the drive train for the conveyor prevents damage to the dish racks or the conveyor system. Referring to FIG. 4, when the conveyor dog 48 is driven against a dish rack which will not move because the discharge table is full of racks ahead of it, the slip clutch mechanism automatically slips to disengage the drive train from the conveyor bar 38. As the eccentric shaft 76 moves to the right attempting to move the pivot lever 56 to the right, the resistance caused by the jammed up dish racks causes lever 86 to be displaced about its pivot pin 98 against the force of spring 100, instead of driving the pivot lever 56 to the right as occurs in normal operation. Bar 86 is able to pivot to the position shown in FIG. 5 due to the ability of the spring 100 to yield and avoid transmitting the force applied to bar 86 to the pivot lever 56. As the eccentric shaft 76 moves back to the left, spring 100 returns bar 86 to its normal position and bar 38 is driven back to the left in the normal manner. During subsequent revolutions of the eccentric shaft 76, bar 86 is able to deflect repeatedly in order to disengage the drive motor from the conveyor bar during one-half of each cycle and thus prevent the conveyor from being forced against the rack to possibly damage the rack and/or the conveyor components. As soon as one or more of the racks is removed from the discharge table, the clutch discontinues its slipping action and the conveyor thereafter operates in the normal manner to convey dish racks through the machine and onto the discharge table.

It is particularly noteworthy that the machine operates automatically without operator intervention as soon as the cycle is started by the placement of one of the racks 14 into the hood 20 far enough to trip bar 236. By minimizing operator control of the machine, machine damage is minimized and the labor costs are reduced significantly. Because the machine is constructed in a manner that requires little servicing, its down time is minimized. All of the controls are set at the factory and need not be adjusted in the field.

The manifolds 162 and spray arms 114 can quickly and easily be removed and replaced following cleaning. During the cleaning process, the spray arm end caps 182 cannot be lost or misplaced, and the amount of time the machine is out of service during cleaning is minimized.

Although the machine has been shown and described as a conveyor type machine, some of its features are equally applicable to other types of machines such as single tank machines that lack a conveyor. For example, the liquid level sensing systems which defect unduly low liquid levels in the wash tank and rinse tank can be used to considerable advantage in single tank machines as well as in conveyor machines. The construction of the manifolds 162 and spray arms 114 and the way in which they are assembled in the machine are advantageous in other types of machines that employ spray arms and the same is true for the captive end caps on the spray arms. Likewise, the formation of the drain plug 134 as part of the filter screen 136 is an arrangement that is useful in both conveyor and non-conveyor machines.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

Having thus described the invention, what is claimed is:

1. In a dish washing machine having spray means for spraying liquid on dishes, a tank for collecting liquid sprayed on the dishes, heating means in the tank for heating the liquid therein and a pump for pumping the liquid from said tank to said spray means, the improvement comprising:

a non-buoyant level sensing member having a predetermined weight in air and a lesser effective weight when fully immersed in the liquid in the tank, said level sensing member having a greater weight than the liquid it displaces when fully immersed in the liquid;

switch means having a first condition allowing energization of said heating means and a second condition preventing energization of said heating means, said switch means including yieldable means for biasing said switch means to the first condition, said yieldable means being overcome to effect the second condition of the switch means upon application thereto of a predetermined force between said predetermined weight and said lesser effective weight; and linkage means for coupling said sensing member with said switch means and suspending said sensing member at a location to be at least partially immersed in the liquid in the tank when the liquid level therein is within a normal range, said sensing member acting on said yieldable means through said linkage means to apply a force in excess of said predetermined force when the liquid level in the tank drops to un unduly low level at which the immersion of said sensing member is reduced from its immersion when the liquid level is within said normal range.

* * * * *